US007074069B2

(12) United States Patent
Nakamura

(10) Patent No.: US 7,074,069 B2
(45) Date of Patent: Jul. 11, 2006

(54) CONNECTOR AND A CONNECTOR ASSEMBLY

(75) Inventor: Hideto Nakamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/738,420

(22) Filed: Dec. 17, 2003

(65) Prior Publication Data

US 2004/0132333 A1 Jul. 8, 2004

(30) Foreign Application Priority Data

Dec. 19, 2002 (JP) ..... 2002-368813

(51) Int. Cl.
*H01R 13/627* (2006.01)

(52) U.S. Cl. ..... 439/352; 439/489

(58) Field of Classification Search ..... 439/488, 439/489, 352

See application file for complete search history.

(56) References Cited

U.S. PATENT DOCUMENTS

| | | | | |
|---|---|---|---|---|
| 4,993,967 | A * | 2/1991 | Matsumoto | 439/489 |
| 5,217,385 | A * | 6/1993 | Inoue et al. | 439/353 |
| 5,362,248 | A | 11/1994 | Hashiguchi et al. | 439/352 |
| 5,910,028 | A * | 6/1999 | Tsuji | 439/489 |
| 6,494,732 | B1 * | 12/2002 | Kashiyama et al. | 439/352 |

* cited by examiner

*Primary Examiner*—Briggitte R. Hammond
(74) *Attorney, Agent, or Firm*—Gerald E. Hespos; Anthony J. Casella

(57) ABSTRACT

A slider (41) surrounds a female housing (30) and can move forward and backward thereon. Springs (46) are provided compressibly between the slider (41) and the female housing (30). A male housing (10) has a receptacle (11) for receiving the female housing (30) and the slider (41). The male housing (10) also has a lock arm (20) engageable with a lock (37) of the female housing (30). The lock arm (20) can interfere with the slider (41) upon being resiliently displaced, but does not interfere with the slider (41) upon being restored. Pushable portions (51) are provided at symmetrical positions on the female housing (30) and are pushable during a connecting operation. The slider (41) has escape grooves (52) for receiving the pushable portions (51).

7 Claims, 11 Drawing Sheets

CONNECTOR AND A CONNECTOR ASSEMBLY

BACKGROUND OF THE INVENTION

1. Field of the Invention

The invention relates to a connector and to a connector assembly with a partial connection preventing function.

2. Description of the Related Art

Japanese Unexamined Utility Model Publication No. H5-81967 discloses a connector with a partial connection preventing function. This connector has male and female housings that are connectable with each other. The male housing has a receptacle and lock arms are formed on the receptacle. A substantially tubular slider is mounted on and surrounds the female housing and springs are provided between the female housing and the slider. The lock arms on the receptacle deform resiliently out to push the slider back as the housings are being connected. As a result, the slider compresses the springs. Biasing forces of the springs are released to separate the housings if the connecting operation is interrupted, thereby preventing partial connection. The lock arms restore to engage locks on the female housing if the housings are connected properly. Simultaneously, the slider is freed from the pushing force and is moved forward due to the biasing forces of the springs.

The slider is pulled back to separate the two housings. More particularly, the slider is retracted back from deformation spaces for the lock arms. Additionally, the lock arms are guided through a resilient deformation by slanted surfaces of the locks and disengage from the locks. Therefore, the two housings can be separated by pulling the slider backward in this state.

The above-described connector has the slider engaged with the outer side of the receptacle. An attempt could be made to have the slider engaged with the inner side of the receptacle. However, this arrangement would require the slider to project back from the receptacle in the connected state of the housings so that the slider could be pulled to separate the two housings. However, the longer slider would cause a new problem in the connecting process. Specifically, the connecting operation is performed by pushing the rear end surface of the female housing and it would be difficult to push the female housing because the projecting slider is a hindrance.

The present invention was developed in view of the above problem and an object thereof is to ensure a good operability.

SUMMARY OF THE INVENTION

The invention relates to a connector with a housing that is connectable with a mating housing. A slider at least partly surrounds the housing and is movable with respect to the housing. A biasing member is provided between the slider and the housing. The biasing member is compressible and accumulates a biasing force for separating the housing from the mating housing as the slider is moved. The housing has one or more pushable portions pushable at the time of connecting the housings, and the slider has one or more escape grooves for escaping the pushable portions.

The connecting operation can be performed by pushing the one or more pushable portions of the housing. The slider is moved relative to the housing in the connecting process and the pushable portions escape in the escape grooves. Thus, the slider is not a hindrance to an operator.

Two pushable portions preferably are provided symmetrically on the housing. Accordingly, the housing can be pushed stably since both pushable portions are arranged substantially symmetrically.

The slider is movable forward and back substantially along the connecting and separating directions of the two housings.

The slider preferably has a substantially tubular shape and surrounds the housing.

The properly connected housings are held by locking means, and the resiliently displacing portion is restored so as not to interfere with the slider. Thus, the biasing force of the biasing member is released to move the slider forward.

The connecting operation is performed by pushing the pushable portions of the first housing. Although the slider is moved back relative to the first housing in the connecting process, both pushable portions escape in the escape grooves. Thus, the slider does not stand as a hindrance to an operator and, therefore, a connecting operability can be improved. Further, the housing can be pushed stably since both pushable portions are arranged symmetrically, whereby the connecting operability can be further improved.

The slider preferably has a substantially rectangular tubular shape and projects backward from a receptacle of the mating housing when the two housings are connected properly.

The slider preferably comprises at least one pullable portion that can be pulled at the time of separating the two housings. Most preferably, two pullable portions are provided at substantially symmetrical positions of a side portion of the slider near side portions where the escape grooves are formed.

The housings are separated by pulling the slider back to disengage the locking means and to compress the biasing means. Thus, a partial connection at the time of separating the two housings is prevented, and operational efficiency is improved during separation.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figures 7A, 7B:
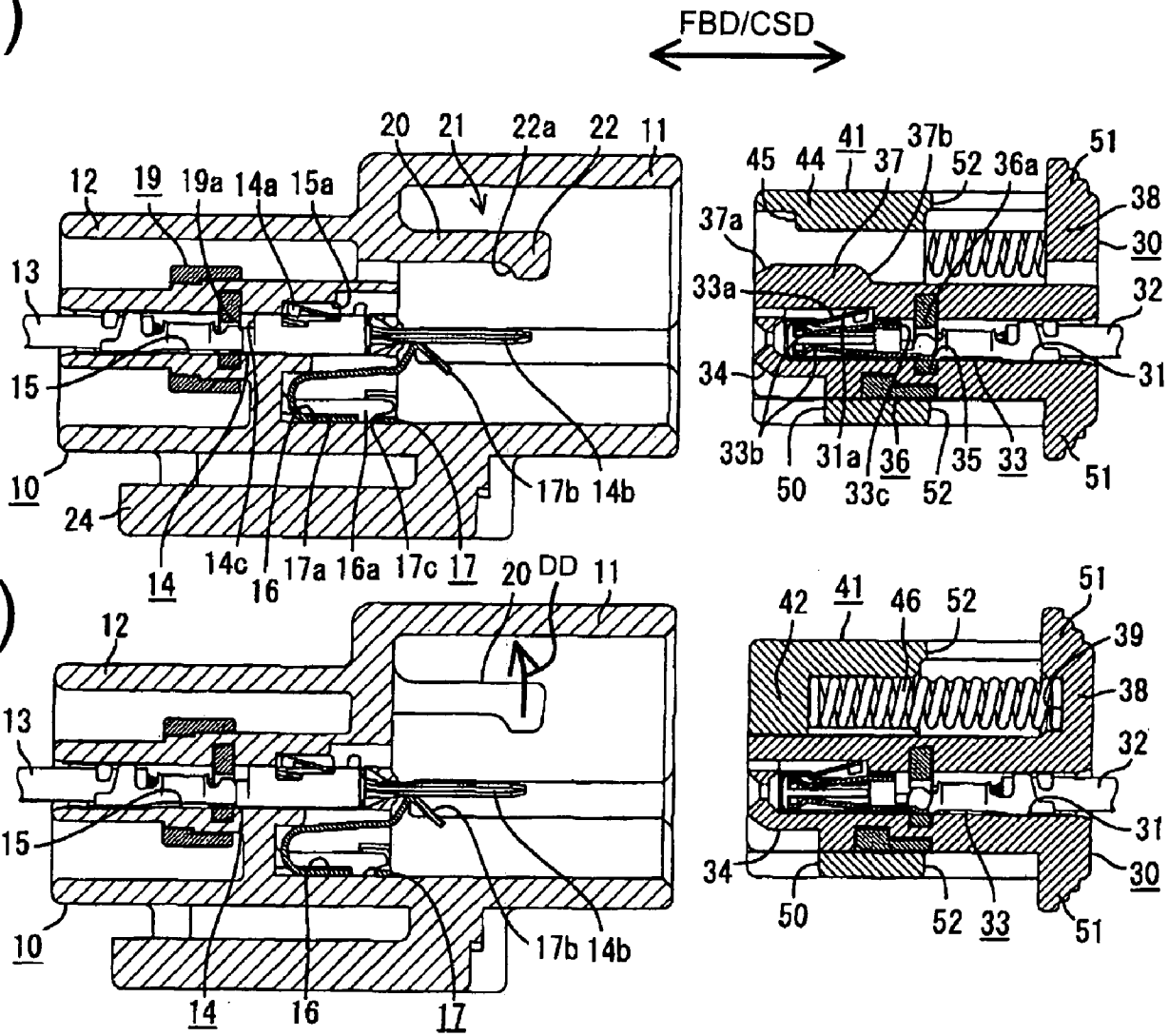
FIGS. 7(A) and 7(B) are sections along 7A—7A and 7B—7B of FIGS. 1 and 2 showing a state before the housings are connected.

A connector according to the invention is described with reference to FIGS. 1 to 13. The connector, as shown in FIG. 7, includes a male housing 10 and a female housing 30 that are connectable with each other. In the following description, sides of the two housings 10, 30 to be connected with each other are referred to as front side.

Figure 1:
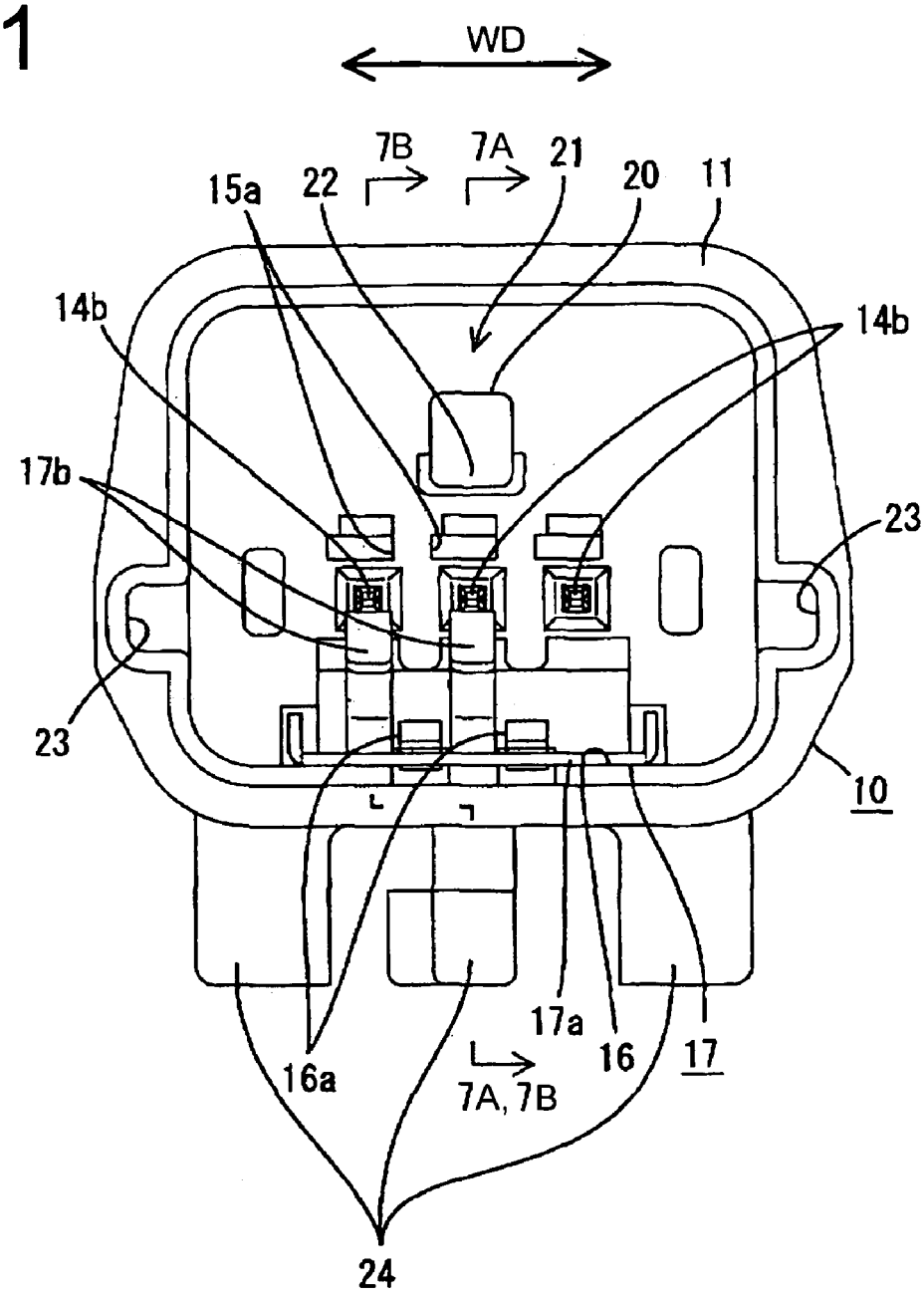
FIG. 1 is a front view of a male housing according to one embodiment of the present invention.
Figure 2:
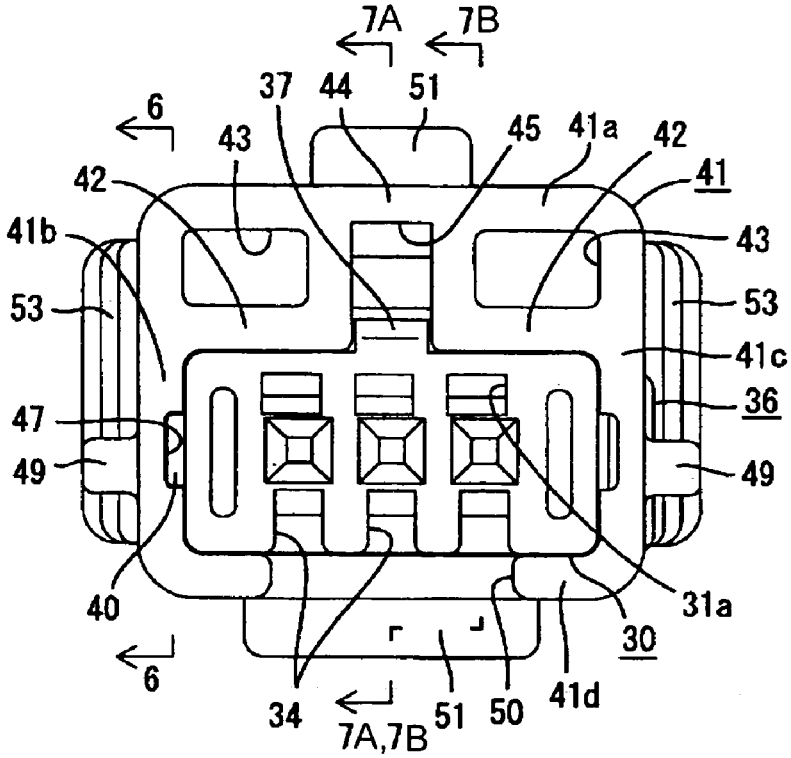
FIG. 2 is a front view of a female housing assembled with a slider.
Figure 3:
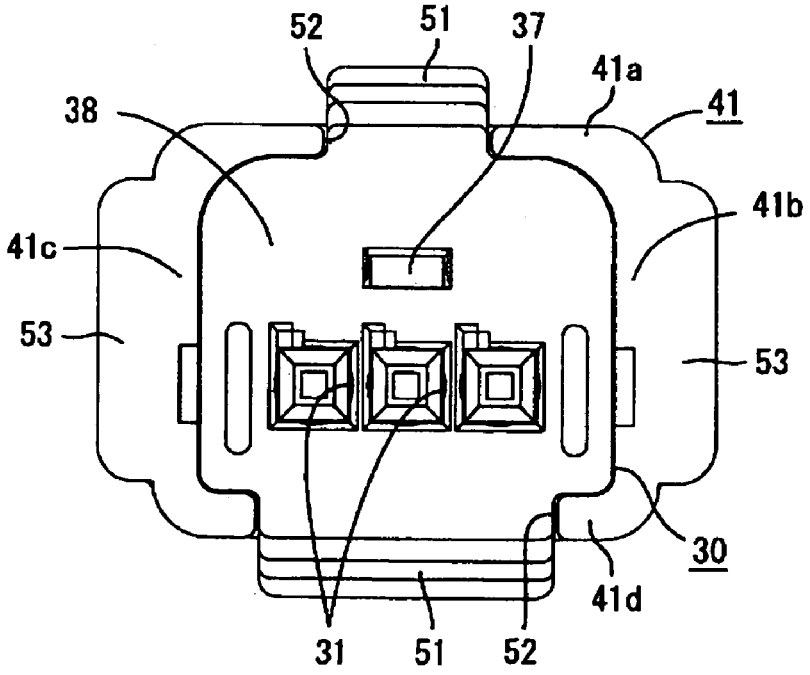
FIG. 3 is a rear view of the female housing assembled with the slider.
Figure 4:
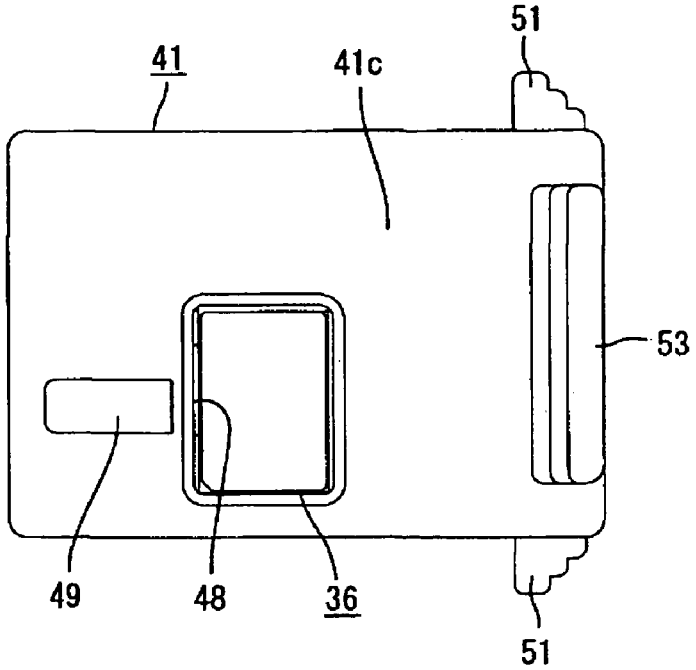
FIG. 4 is a side view of the female housing assembled with the slider.
Figure 5:
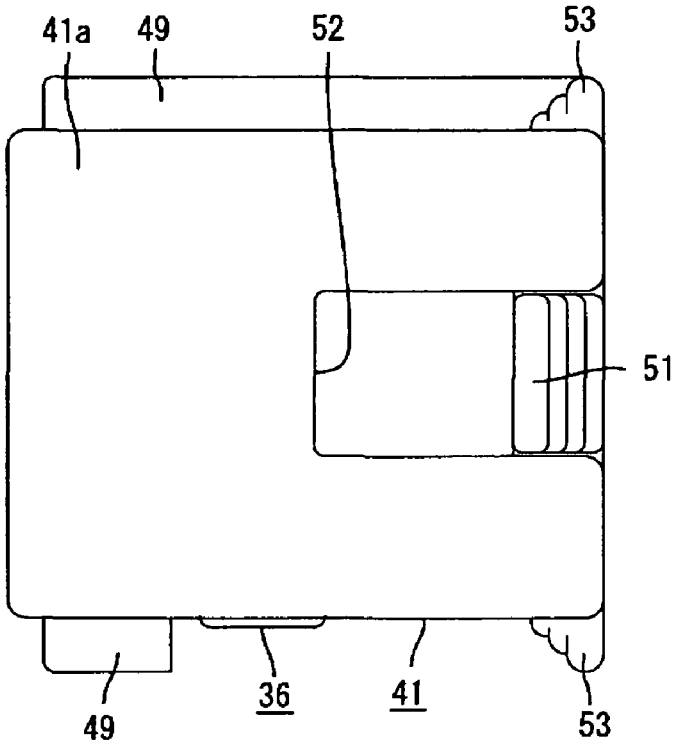
FIG. 5 is a plan view of the female housing assembled with the slider.
Figure 6:
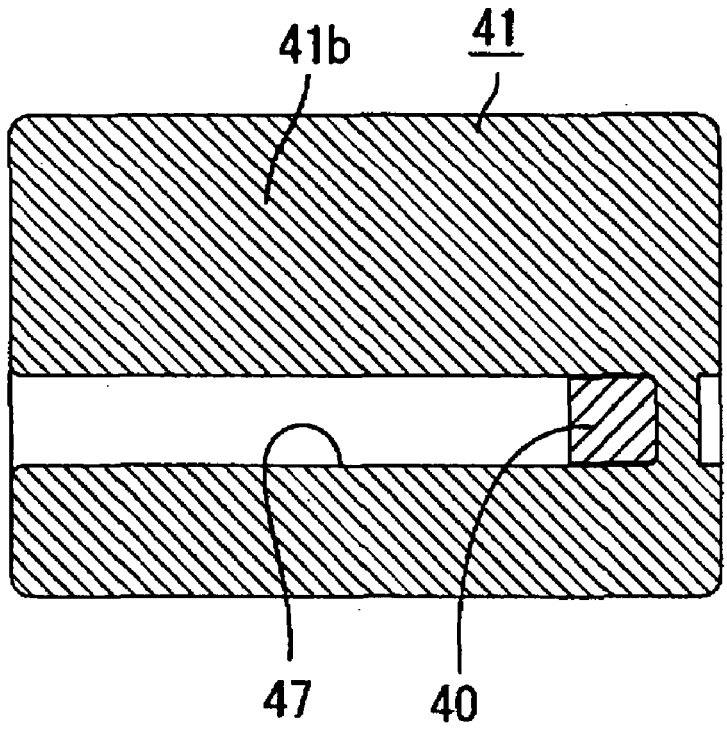
FIG. 6 is a section along 6—6 of FIG. 2.

The male housing 10 is made e.g. of a synthetic resin and, as shown in FIGS. 1 and 7, has a substantially tubular receptacle 11 with an open front end. The male housing 10 also includes a terminal-accommodating portion 12 rearward of the receptacle 11. Three wires 13 are connected respectively to the rear ends of three male terminal fittings 14. Each male terminal fitting 14 has a lock 14*a* that is cut and bent from an intermediate part of the terminal fitting 14. Additionally, each male terminal fitting 14 has a tab 14*b* projecting forward at the front end of the terminal fitting 14. Cavities 15 are formed substantially side-by-side along a widthwise direction WD in the terminal accommodating portion 12 and the male terminal fittings 14 are insertable into the cavities 15 from behind. A locking groove 15*a* is formed in the ceiling surface of each cavity 15 and has an open front end and a closed rear end. The locks 14*a* of the male terminal fittings 14 are engageable with the closed rear ends of locking grooves 15*a* to hold the male terminal fittings 14 in the respective cavities 15.

A shorting-terminal accommodating chamber 16 is formed in the terminal accommodating portion 12 below the respective cavities 15 and has an open front end. A shorting terminal 17 is accommodated in the shorting-terminal accommodating chamber 16. The shorting terminal 17 includes a main portion 17*a* in the form of a substantially flat plate. Resilient contact pieces 17*b* project from the rear end of the main portion 17*a*. The leading ends of the respective resilient contact pieces 17*b* project into the receptacle 11 and are brought resiliently into contact with the tabs 14*b* of the two male terminal fittings 14 in the middle and left cavities 15 in FIG. 1, thereby short-circuiting the two male terminals 14. Two holding pieces 16*a* are provided in the shorting-terminal accommodating chamber 16 and are resiliently engageable with locking holes 17*c* formed in the main portion 17*a*.

A retainer mount hole is formed in one side surface at a rear part of the terminal accommodating portion 12 and communicates with the respective cavities 15. A retainer 19 can be moved in the widthwise direction WD in the retainer mount hole between partial and full locking positions. Additionally, the retainer 19 can be held selectively in the male housing 10 by an unillustrated holding means at the partial locking position or at the full locking position. The retainer 19 has locking sections 19*a* that are retracted sideways from the cavities 15 to permit insertion and withdrawal of the respective male terminal fittings 14 into and from the cavities 15 when the retainer is at the partial locking position. However, the locking sections 19*a* enter the respective cavities 15 and engage jaws 14*c* to lock the male terminal fittings 14 redundantly when the retainer 19 is at the full locking position.

The receptacle 11 has an opening that is dimensioned to receive the female housing 30 and the slider 41. A lock arm 20 cantilevers forwardly from a substantially widthwise-middle position of the back surface of the receptacle 11 above the respective cavities 15. The lock arm 20 is resiliently displaceable substantially vertically along a displacement direction DD about its base end at the back surface of the receptacle 11, and can be retracted into a displacement permitting space 21 between the lock arm 20 and the ceiling surface of the receptacle 11. A hook 22 projects down at the leading end of the lock arm 20 and is sloped up and out towards the back. Two guiding recesses 23 are formed in substantially opposite inner side surfaces of the receptacle 11 to face each other. The guiding recesses 23 engage corresponding guiding ribs 49 of the slider 41. Further, a mounting portion 24 used to mount the male housing 10 on an unillustrated bracket projects from the bottom of the male housing 10.

The female housing 30 is made e.g. of a synthetic resin, and is in the form of a wide block with three cavities 31 arranged substantially side-by-side along a widthwise direction WD. Female terminal fittings 33 are crimped into connection with ends of wires 32 and are insertable into the respective cavities 31 from behind. A locking groove 31*a* is formed in the ceiling surface of each cavity 31 and has an open front end and a closed rear end. A locking portion 33*a* is formed by making a cut in the female terminal fitting 33 and bending the cut portion for resilient engagement with the locking groove 31*a*. Each female terminal fitting 33 is provided internally with a resilient contact piece 33*b* that can contact the tab 14*b* of the male terminal fitting 14. Three engaging recesses 34 are formed in the bottom surface at the front end of the female housing 30 right below the respective cavities 31 and are eengageable with the respective resilient contact pieces 17*b* of the shorting terminal 17. Engaging surfaces of the engaging recesses 34 with the resilient contact pieces 17*b* are slanted out and to the back (down to right in FIG. 7) so that the resilient contact pieces 17*b* can be deformed smoothly out and down. A retainer mount hole 35 is formed in one side surface of the female housing 30 and communicates with the respective cavities 31. A retainer 36 can be inserted into the retainer mount hole 35. The retainer 36 has locking sections 36*a* engageable with jaws 33*c* of the female terminal fittings 33. The retainer 36 can be held in the female housing 30 at a partial locking position and at a full locking position similar to the aforementioned retainer 19 of the male housing 10.

A lock 37 projects at a substantially widthwise middle position of the front end or front end of the upper surface of the female housing 30 and is engageable with the lock arm 20. The lock 37 is at substantially the same height as the hook 22, and a front surface 37*a* of the lock 37 is slanted up and to the back to guide a movement of the lock arm 20 onto the lock 37. On the other hand, a rear surface 37*b* of the lock 37 has an arcuate shape sloped down and to the back to extend along the rear surface 22*a* of the hook 22 of the lock arm 20. Thus, the lock arm 20 is displaced automatically to cancel the locked state when a force of a specified intensity or larger acts to separate the two housings 10, 30. In other words, a locking means of this connector takes a semi-locking construction.

A rear wall 38 projects up at the rear end of the upper surface of the female housing 30 and has substantially the same width as the female housing 30. Two spring receiving portions 39 are formed by recessing opposite widthwise sides of the rear wall 38 for supporting and positioning the rear ends of the compression coil springs 46. Further, two front-stop projections 40 project from the opposite outer side surfaces of the rear end of the female housing 30 for stopping the slider 41 at its front-limit position.

The slider 41 is mountable onto the outer surface of the female housing 30 from the front. This slider 41 is made e.g. of a synthetic resin, and is a substantially rectangular tube with upper, lower, left and right walls 41*a* to 41*d* shown in FIG. 2. The slider 41 has a length substantially equal to the length of the female housing 30, and can surround the female housing 30 over substantially the entire periphery. Alternatively, the slider 41 may have a length to at least partly cover the female housing 30 while fully covering the female housing 30 around the periphery. The lengths of the slider 41 and the female housing 31 exceed the length of the receptacle 11 along a forward and backward direction FBD. Thus, the rear ends of the female housing 30 and the slider 41 project back from the receptacle 11 when the two housings 10, 30 are connected properly (see FIGS. 10 and 11). In its mounted state, the slider 41 is movable forward and backward substantially along the connecting and separating directions CSD of the two housings 10, 30, and the inner peripheral surface of the slider 41 is held in sliding contact with substantially the entire outer peripheral surface of the female housing 30 during its movement.

Two spring pressing portions 42 project at opposite widthwise sides of the upper wall 41*a* of the slider 41 for supporting the front ends of the compression coil springs 46 while tightly holding the compression coil springs 46 in cooperation with the spring receiving portions 39. The two spring pressing portions 42 have widths and heights so that the lock 37 is held from opposite sides by the spring pressing portions 42 and the lower surfaces of the spring pressing portions 42 are held substantially in slidable contact with the upper surface of the female housing 30 in the mounted state of the slider 41. Two bores 43 are formed in the front surfaces of the upper wall 41*a* and the two spring pressing portions 42 to avoid sink marks during molding.

In the mounted state of the slider 41, a space is defined between the lock 37 and a lower surface of the upper wall 41*a* of the slider 41 at a location between the two spring pressing portions 41. The space has a height substantially corresponding to the height of the lock arm 20 rearward of the hook 22. Thus, the lock arm 20 in its natural state can enter this space. This substantially widthwise middle of the upper wall 41*a* defines a displacement-preventing portion 44 for entering the displacement permitting space 21 for the lock arm 20 to prevent a displacement of the lock arm 20 when the two housings 10, 30 are connected properly (see FIG. 10(A)). A displacement-permitting recess 45 is formed in the inner surface of the front end of the displacement-preventing portion 44 and has an open front end (see FIG. 8(A)). The displacement-permitting recess 45 permits the lock arm 20 to undergo a resilient displacement for moving onto the lock arm 37. The front end surface of the resiliently displaced lock arm 20 can contact the back end surface of the displacement-permitting recess 45. Accordingly, the lock arm 20 can interfere with the slider 41 upon being resiliently displaced while being unable to interfere therewith substantially in its natural state.

Two front-stop grooves 47 are formed in the left and right walls 41*b*, 41*c* of the slider 41 and are engageable with the front-stop projections 40 of the female housing 30. The slider 41 can be held at its front-limit position on the female housing 30 (see FIG. 6) by the engagement of the front-stop projections 40 and the front-stop grooves 47. The front and rear end surfaces of the female housing 30 and the slider 41 are substantially flush with each other when the slider 41 is at the front-limit position (state shown in FIGS. 4, 5 and 7), and the compression coil springs 46 are compressed slightly to prevent shaking of the slider 41. A retainer insertion hole 48 is formed in the right wall 41*c* of the slider 41 (see FIG. 4) and aligns with the retainer mount hole 35 when the slider 41 is at the front-limit position (see FIG. 4). Thus, the retainer 36 can be inserted through the retainer insertion hole 48 and the retainer mount hole 35. Two guiding ribs 49 are formed on the outer surfaces of the left and right walls 41*b*, 41*c* of the slider 41 for guiding the movement of the slider 41 by the engagement with the guiding recesses 23 of the male housing 10.

A cut-away portion 50 is formed at the front end of the lower wall 41*d* of the slider 41 for receiving the resilient contact pieces 17*b* of the shorting terminal 17. The cut-away portion 50 is formed across a width area to intersect all the engaging recesses 34, and the front end of the cut-away portion 50 substantially aligns with the front ends of the engaging recesses 34 when the slider 41 is at the front-limit position on the female housing 30.

Two pushable portions 51 are provided on the upper and lower surfaces of the rear end of the female housing 30 and can be pushed during the connection of the two housings 10, 30. The two pushable portions 51 are at substantially vertically symmetrical positions on the female housing 30, and have heights to project up or down from the slider 41 by a specified distance in the mounted state of the slider 41. Each pushable portion 51 has steps whose outward-projecting distance is larger toward the front, so that an operator can easily push it. Further, the upper pushable portion 51 is narrower than the lower pushable portion 51.

Figure 12A:
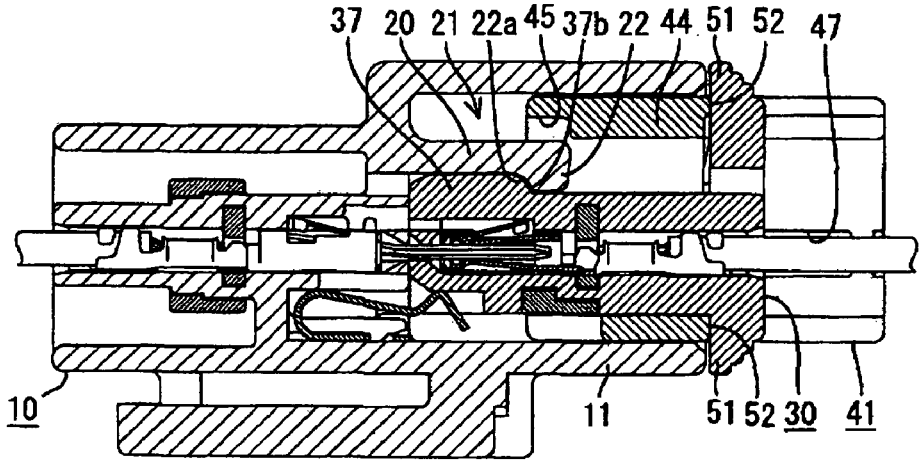
FIGS. 12(A) and 12(B) are sections similar to FIGS. 7(A) and 7(B) showing a state where the slider is moved backward.
Figure 12B:
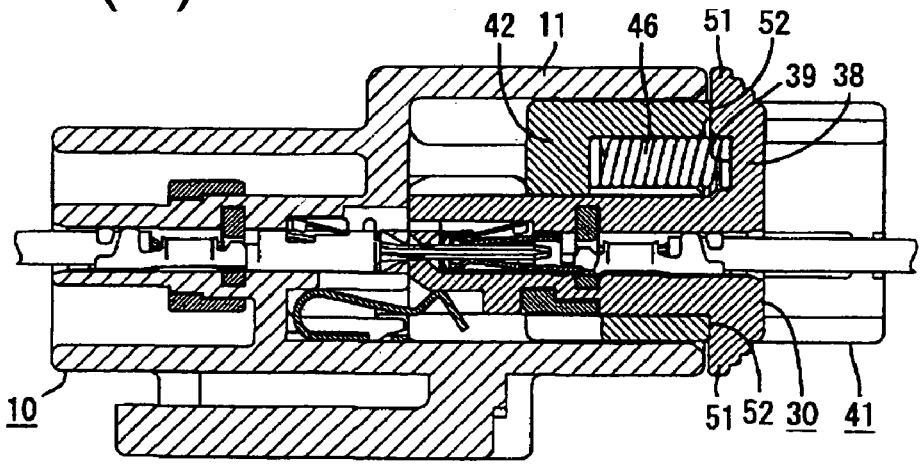

Two rearwardly open escape grooves 52 are formed respectively in the upper and lower walls 41*a*, 41*d* of the slider 41 in positions corresponding to the pushable portions 51. The escape grooves 52 are formed by cutting off portions of the upper and lower walls 41*a*, 41*d* and have substantially the same widths as the corresponding pushable portions 51. Thus, the pushable portions 51 are held between the remaining portions of the upper and lower walls 41*a*, 41*d*. The escape grooves 52 are formed over a sufficient length for the front surfaces of the pushable portions 51 to be held in contact with the back end surfaces of the corresponding escape grooves 52 when the slider 41 is moved maximally back relative to the female housing 30 (i.e. a state where the displacement preventing portion 44 is retracted from the displacement permitting space 21 for the lock arm 20 as shown in FIG. 12 with the two housings 10, 30 properly connected). The escape grooves 52 can escape the pushable portions 51 even with the slider 41 held at the front-limit position on the female housing 30 (see FIG. 5).

Two pullable portions 53 project laterally from the outer surfaces of the rear ends of the left and right walls 41*b*, 41*c* of the slider 41 and are used to pull the slider 41 for separating the two housings 10, 30. The two pullable portions 53 are arranged substantially at transversely symmetrical positions of the slider 41. Each pullable portion 53 is enlarged towards the back preferably by having steps whose outward-projecting distance is larger toward the back, so that the operator can easily pull it. The front ends of the pullable portions 53 are more backward than those of the pushable portions 51 by a specified distance. Thus, the pullable portions 53 are spaced apart from the front end surface of the receptacle 11 by this specified distance when the two housings 10, 30 are connected (see FIG. 11). Both pullable portions 53 have a height slightly shorter than the height of the slider 41, and the maximum outward-projecting distance thereof is substantially equal to the projecting distance of the guiding ribs 49.

The compression coil springs 46 and the slider 41 are assembled successively with the female housing 30 from front and are held at the front-limit position. Additionally, the retainer 36 and the female terminal fittings 33 are mounted into the female housing 30. On the other hand, the shorting terminal 17, the male terminal fittings 14 and the retainer 19 are assembled with the male housing 10 to attain the state shown in FIG. 7. Thereafter, the two housings 10, 30 are connected.

Figure 8A:
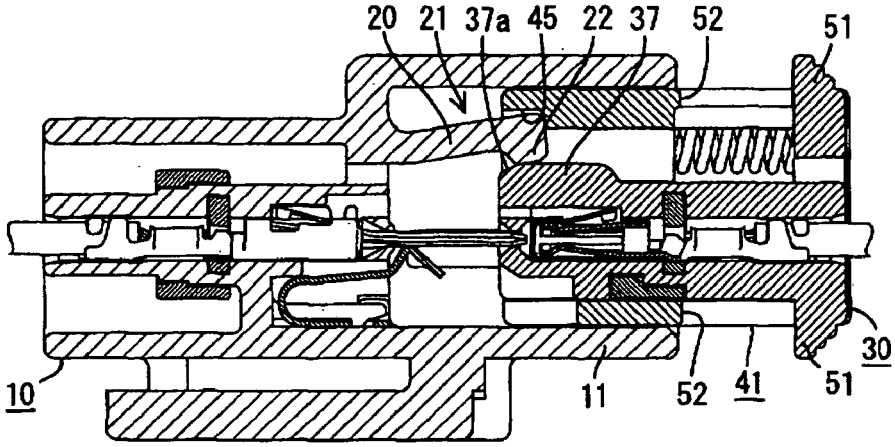
FIGS. 8(A) and 8(B) are sections similar to FIGS. 7(A) and 7(B) but showing an initial stage of the connection of the two housings.
Figure 8B:
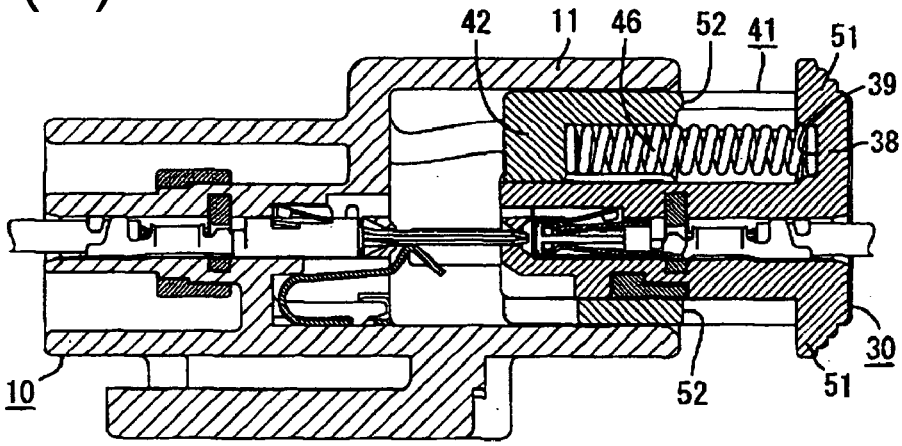

As shown in FIG. 7, the upper and lower pushable portions 51 of the female housing 30 are pushed while the female housing 30 and the slider 41 are opposed to the receptacle 11 of the male housing 10 from the front. As a result, the female housing 30 is fit into the receptacle 11 together with the slider 41. The hook 22 is guided onto the lock 37 by the front surface 37*a* of the lock portion 37, as shown in FIG. 8, when the two housings 10, 30 are connected to a specified depth. Thus, the lock arm 20 is displaced resiliently up in the displacement direction DD and retracts into the displacement permitting space 21 and the displacement permitting recess 45.

Figure 9A:
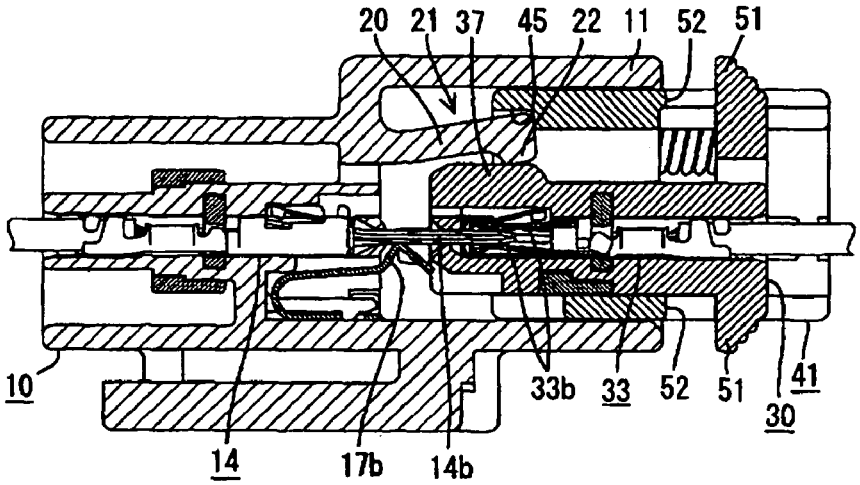
FIGS. 9(A) and 9(B) are sections similar to FIGS. 7(A) and 7(B) but show an intermediate stage of the connection of the two housings.
Figure 9B:
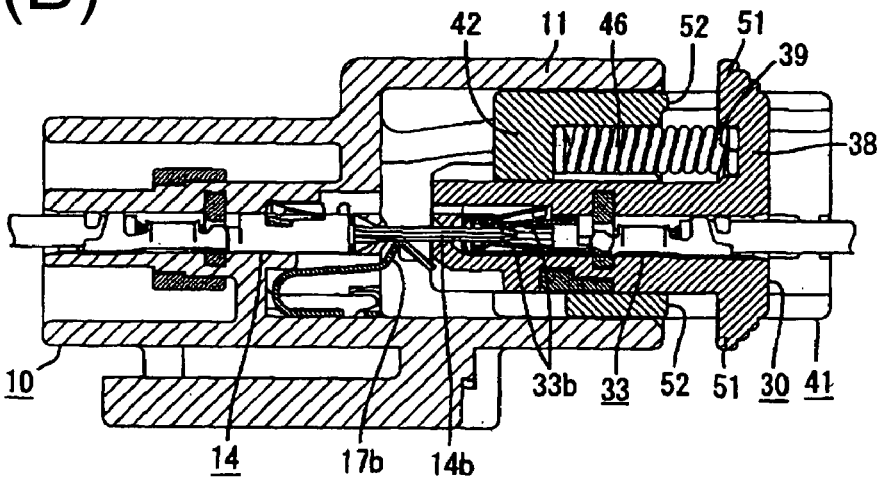
Figure 10A:
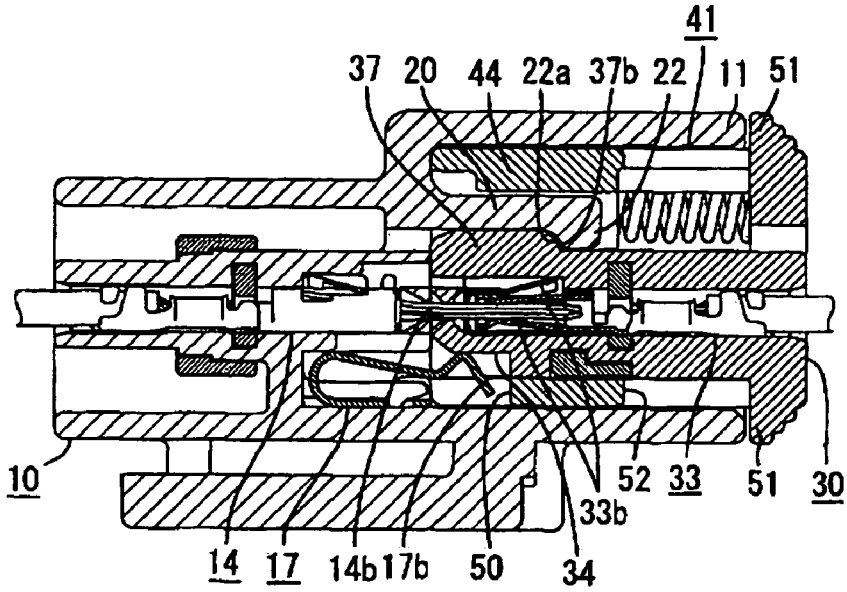
FIGS. 10(A) and 10(B) are sections FIGS. 7(A) and 7(B) but show a state where the two housings are connected.
Figure 10B:
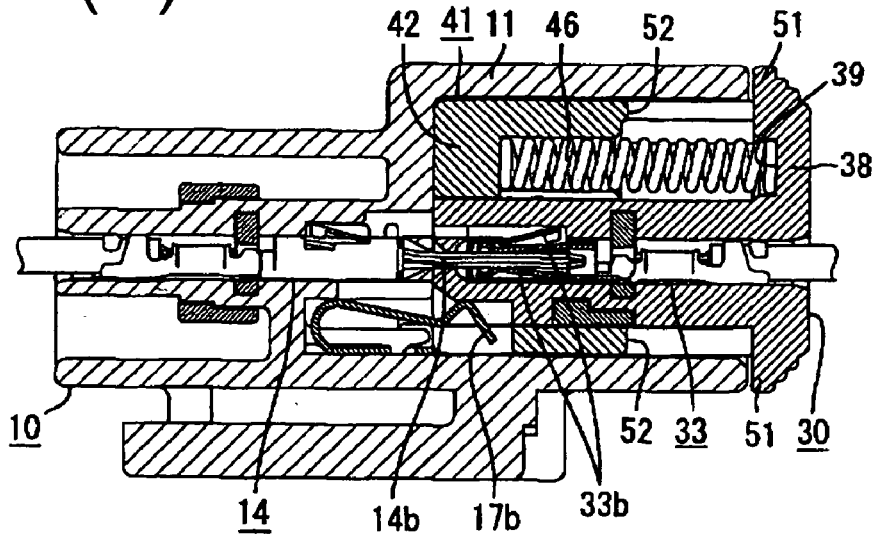
Figure 11:
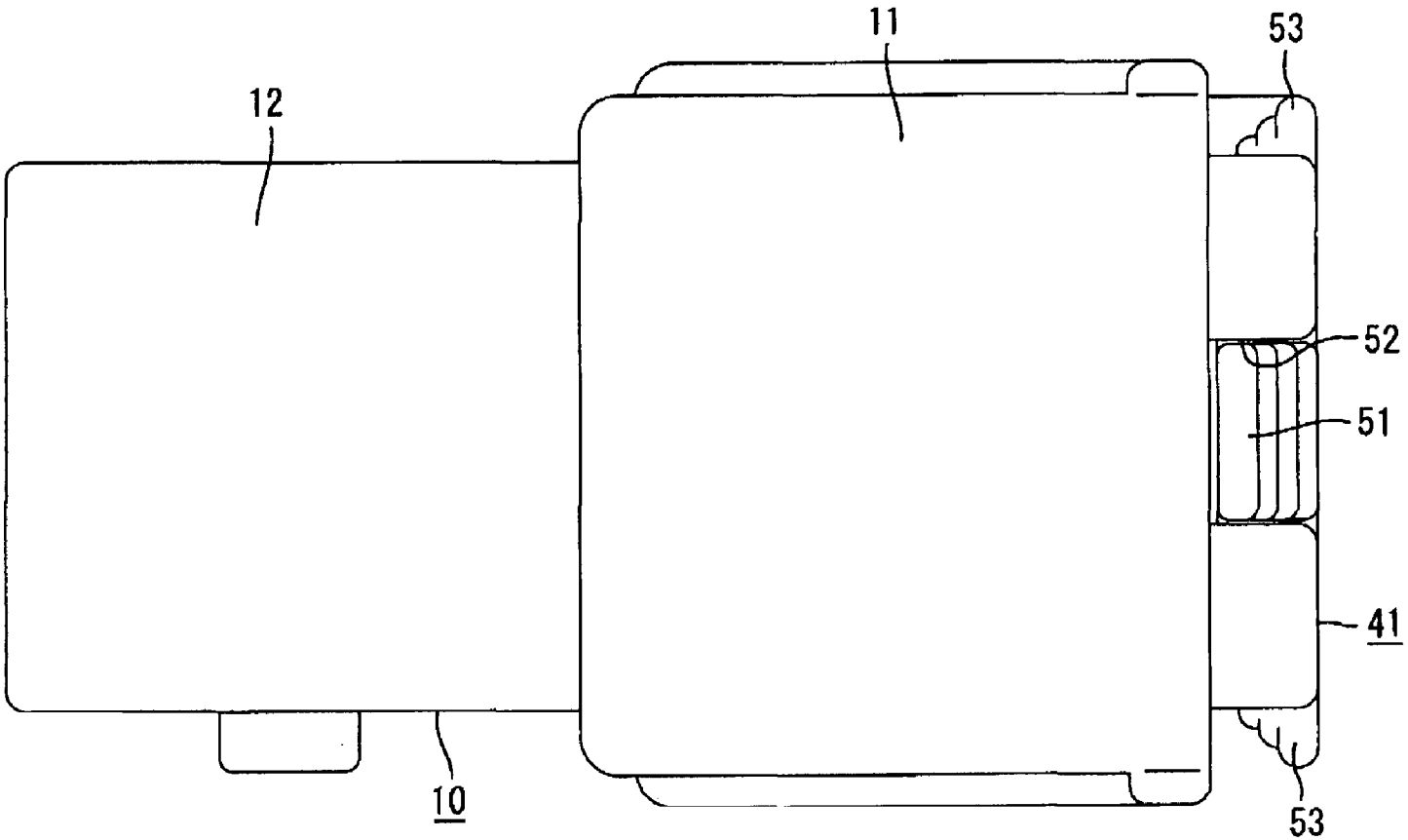
FIG. 11 is a plan view showing a properly connected state of the two housings.

As the connecting operation proceeds from this state, the back end surface of the displacement permitting recess 45 is pushed by the front end surface of the resiliently displaced lock arm 20. As a result, the slider 41 is moved back relative to the female housing 30 and the compression coil springs 46 are compressed as shown in FIGS. 9(A) and 9(B). The pushable portions 51 escape into the escape grooves 52 in the process of moving the slider 41 back. Thus, the pushable portions 51 do not hinder movement of the slider 41. Further, the tabs 14*b* of the male terminal fittings 14 start being resiliently brought substantially into contact with the resilient contact pieces 33*b* of the female terminal fittings 33.

The operator could interrupt the connecting operation at an intermediate stage. However, biasing forces accumulated in the compressed compression coil springs 46 are released. Thus, the slider 41 is biased forward to push the lock arm 20 in separating direction and to forcibly separate the two housings 10, 30. In this way, the two housings 10, 30 are prevented from being left partly connected.

When the two housings 10, 30 are connected to a substantially proper depth, the hook 22 moves over the lock 37 and the lock arm 20 is resiliently restored to engage the rear surface 22*a* of the hook 22 with the rear surface 37*b* of the lock 37. Simultaneously, the front end surface of the lock arm 20 disengages from the back end surface of the displacement permitting recess 45 to cancel the pushed state of the slider 41. Accordingly, the lock arm 20 no longer interferes with the slider 41. Thus, the biasing forces accumulated in the compression coil springs 46 are released to move the slider 41 forward until the slider 41 reaches the front-limit position where the slider 41 was located before the connecting operation. As the slider 41 is moved forward, the displacement-preventing portion 44 enters the displacement permitting space 21 for the lock arm 20 to prevent the resilient displacement of the lock arm 20 in the displacement direction DD. In this way, the two housings 10, 30 are locked redundantly and cannot be separated from each other. In the process of properly connecting the two housings 10, 30, the respective resilient contact pieces 17*b* of the shorting terminal 17 are displaced resiliently down by the engaging recesses 34 and are separated from the tabs 14*b* into the engaging recesses 34 and the cut-away portion 50. Therefore, the two male terminal fittings 14 are freed from the shorted state.

Figure 13A:
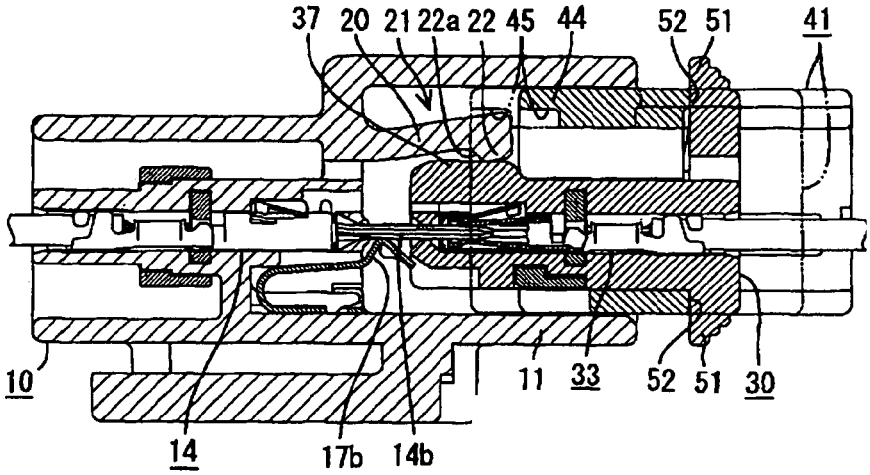
FIGS. 13(A) and 13(B) are sections similar to FIGS. 7(A) and 7(B) showing an intermediate stage of the separation of the two housings.
Figure 13B:
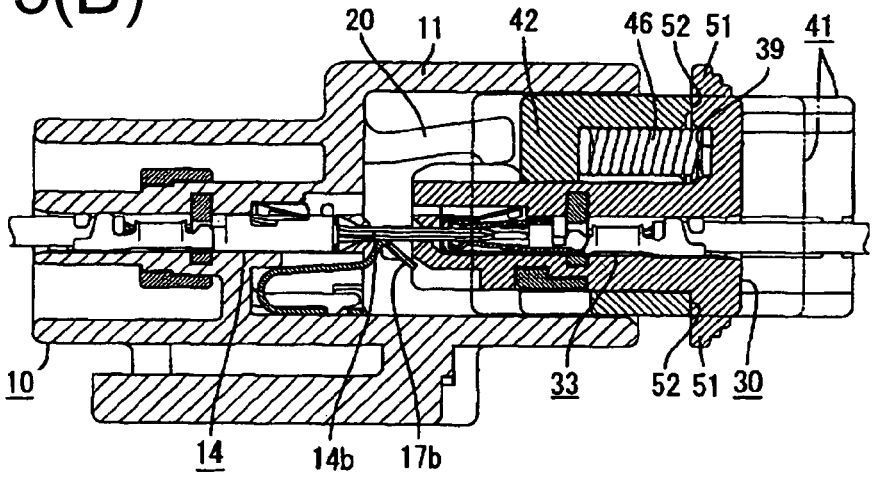

On the other hand, the two housings 10, 30 may be separated for maintenance or other reason. In such a case, the left and right pullable portions 53 at the rear end of the slider 41 are pulled. The pullable portions 53 are spaced back from the front end surface of the receptacle 11 by the specified distance and are stepped. Thus, the pullable portions can be pulled easily. The slider 41 is moved backward against the biasing forces of the compression coil springs 46 to bring the front surfaces of the pushable portions 51 into contact with the back end surfaces of the escape grooves 52. Thus, the displacement preventing portion 44 is retracted completely from the displacement permitting space 21 for the lock arm 20 and the displacement permitting recess 45 is located above the front end of the lock arm 20 as shown in FIG. 12. As a result, the lock arm 20 can be displaced. The slider 41 is pulled farther backward in this state so that the lock arm 20 is displaced automatically due to the semi-locking construction described above. More particularly, the lock arm 20 is guided by the rear surface 22*a* of the hook 22 and the rear surface 37*b* of the lock 37, as shown in FIG. 13, to cancel the locked state. The female housing 30 and the slider 41 can be pulled out of the receptacle 11 by pulling the slider 41 further backward in this state.

The operator could interrupt the connecting operation at an intermediate stage. However, the biasing forces of the compression coil springs 46 accumulated by moving the slider 41 backward are released and will move the slider 41 forward as shown in phantom in FIG. 13. Thus, the front end surface of the resiliently displaced lock arm 20 contacts the back end surface of the displacement permitting recess 45 to separate the two housings 10, 30. Thus, the two housings 10, 30 can be prevented from being left partly connected while being separated.

As described above, even if the slider 41 is moved back to project more backward than the female housing 30 in the connecting process, the pushable portions 51 escape into the escape grooves 52 of the slider 41. Thus, the backward-moving slider 41 does not hinder the operator, thereby making a connecting operability better. Further, the pushable portions 51 are arranged at the substantially vertically symmetrical positions on the female housing 30. Therefore, the female housing 30 can be pushed stably as compared, for example, to a case where the pushable portion is provided only at one side. Thus, the connecting operability is even better.

The slider 41 can be moved back at the time of separating the two housings 10, 30 by pulling the pullable portions 53 arranged at the opposite and transversely symmetrical positions on the slider 41. Thus, a separating operability can also be made better.

The rear end positions of the slider 41 at the front-limit position and the female housing 30 can be aligned since the pushable portions 51 escape into the escape grooves 52 with the slider 41 held at the front-limit position on the female housing 30. Accordingly, the length of the connector can be shortened as compared, for example, to a case where the slider is formed with no escape groove and the female housing projects back from the slider by as much as the moving stroke of the slider at the front-limit position of the slider.

The lock arm 20 is both the locking means and the resiliently displacing portion. Thus, the construction of the connector is simplified.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The lengths of the female housing and the slider are substantially equal in the foregoing embodiment. However, they may differ. For instance, at the front-limit position, the slider may be before the pushable portions so that the pushable portions escape into the escape grooves only when the slider is moved backward.

Although the lock arm forming the locking means serves also as the resiliently displacing portion as claimed in the foregoing embodiment, a resiliently displacing portion for exclusive use may be provided separately from the lock arm according to the present invention.

Although the locking means takes a semi-locking construction and the displacement of the lock arm is prevented by the displacement preventing portion of the slider in the foregoing embodiment, the displacement preventing portion may be omitted and the locking means may take an ordinary locking construction (for example, such a construction comprised of vertical straight rear surfaces of the hooking portion and the lock portion) according to the present invention.

Converse to the foregoing embodiment, the slider and the compression coil springs may be assembled with the male housing and the lock arm may be provided at the female housing according to the present invention.

Although a so-called wire-to-wire connector is illustrated in the foregoing embodiment, the present invention is also applicable, for example, to such a type of connectors that (male or female) housings are directly connected with equipments, such as junction boxes, airbag circuits, panel-equipment, waiting side connectors, etc.

The invention has been described with reference to a female housing where the slider is movable with respect to the connection and separation directions of the female and male housings. However, the invention is also applicable to sliders movable with respect to the housing at an angle to the connection and separating directions, provided that the slider is capable of separating the two housings when they are not properly connected with each other, e.g. when the connection of the housings is interrupted before reaching the properly connected state.

What is claimed is:

1. A connector connectable with a mating housing, the connector comprising:

a housing having a front end connectable with the mating housing, a rear end and at least one terminal-receiving cavity extending between the ends, the rear end of the housing being formed to define two pushable portions symmetrically disposed on the housing and configured for receiving a forward pushing force for connecting the housing with the mating housing;

a slider that is movable with respect to the housing, the slider being formed with at least one rearwardly open escape groove for receiving the pushable portion of the housing; and a biasing member provided between the slider and the housing and being compressible to accumulate a biasing force for separating the housing from the mating housing as the slider is moved.

2. The connector of claim 1 wherein the slider is movable forward and backward substantially along connecting and separating directions of the housing and the mating housing.

3. The connector of claim 1 wherein the slider has a substantially tubular shape for at least partly surrounding the housing.

4. The connector of claim 3, wherein the slider has a substantially rectangular tubular shape and is configured to project back from a receptacle of the mating housing when the housing and the mating housing are connected properly.

5. The connector of claim 1, wherein the slider comprises at least one pullable portion pullable for separating the housing from the mating housing.

6. The connector of claim 5, wherein two pullable portions are provided substantially symmetrically on sides of the slider neighboring sides where the escape grooves are formed.

7. A connector assembly comprising;

a housing and a mating housing that are connectable with one another, at least one pushable portion formed on the housing and configured for pushing the housing towards the mating housing to achieve connection;

a slider movable with respect to the housing and at least partly surrounding the housing, the slider being formed with at least one escape groove for receiving the pushable portion of the housing; and a biasing member provided between the slider and the housing and being compressible to accumulate a biasing force for separating the housing from the mating housing as the slider is moved, wherein the mating housing includes a resilient displacing portion which is resiliently displaceable to interfere with the slider during the connection and separation of the housings while being restored so as not to interfere with the slider when the two housings are connected properly.

* * * * *